US005238323A

United States Patent [19]

Allen et al.

[11] Patent Number: 5,238,323

[45] Date of Patent: Aug. 24, 1993

[54] RIDING TROWEL FOR CONCRETE FINISHING

[75] Inventors: J. Dewayne Allen, Paragould; Hugh L. Adams, Bassett, both of Ark.

[73] Assignee: Allen Engineering Corporation, Paragould, Ark.

[21] Appl. No.: 823,475

[22] Filed: Jan. 22, 1992

Related U.S. Application Data

[63] Continuation-in-part of Ser. No. 553,445, Jul. 13, 1990, Pat. No. 5,108,220.

[51] Int. Cl.[5] ..... E01C 19/00; E01C 19/22

[52] U.S. Cl. ..... 404/85; 404/112

[58] Field of Search ..... 404/84.05, 112, 85, 404/86, 97, 101, 112; 280/43

[56] References Cited

U.S. PATENT DOCUMENTS

| | | | |
|---|---|---|---|
| 3,564,986 | 10/1968 | Burgin | 404/84.2 |
| 3,936,212 | 2/1976 | Holz, Sr. et al. | 404/112 |
| 4,046,483 | 9/1977 | Sutherland | 404/112 |
| 4,046,484 | 9/1977 | Holz, Sr. et al. | 404/112 |
| 4,312,603 | 1/1982 | Whiteman, Jr. | 404/112 |
| 4,710,055 | 12/1987 | Maass et al. | 404/112 |

*Primary Examiner*—Ramon S. Britts
*Assistant Examiner*—Nancy P. Connolly
*Attorney, Agent, or Firm*—Stephen D. Carver

[57] ABSTRACT

A riding trowel used for concrete finishing includes a dolly wheel lifting system. The lifting system elevates the trowel out of contact with the concrete surface when transporting, adjusting, or maintenancing the trowel. The trowel comprises a rigid metallic frame normally offset from the concrete surface to be finished by a pair of downwardly projecting, bladed rotors. A pair of primary steering control levers is linked to the rotors beneath the frame for trowel operation. Each rotor assembly comprises a rotatable blade assembly depending downwardly into contact with the concrete surface. The wheel system comprises a cooperating pair of spaced apart, dolly wheel assemblies which are removably fitted to the front and back of the frame, so that the trowel may be pushed around for loading and unloading purposes in directions generally coincident with its longitudinal axis. Each dolly wheel assembly comprises an upright, extensible stanchion supported upon a rigid cross piece extending between a pair of spaced apart wheels. The stanchion mounts a pair of rigid, spaced apart rods that are adapted to be mated to suitable mandrels formed in the frame front and rear, about the trowel center of gravity. The stanchion comprises upper and lower tubular members that are telescoped together and which may be axially displaced or retracted by an internal screw jack to raise or lower the trowel. When the trowel is raised above the concrete surface, the blades are safely exposed for servicing.

8 Claims, 5 Drawing Sheets

RIDING TROWEL FOR CONCRETE FINISHING

CROSS REFERENCED TO RELATED APPLICATION

This application is a Continuation-in-Part of our previously filed U.S. patent application, Ser. No. 07/553,445, filed July 13, 1990, and entitled Light Weight, Fast Steering Riding Trowel, now Pat. No. 5,108,220.

BACKGROUND OF THE INVENTION

1 Field of the Invention

The present invention relates generally to riding-type concrete finishing machines. More particularly, the present invention relates to riding-type concrete finishing trowels comprising a pair of rotatable blade-equipped rotors including control means for independently tilting the levers to effectuate enhanced steering. Representative self propelled riding trowels are classified in United States Class 404, Subclass 112.

2. Description of the Prior Art As will be recognized by those skilled in the art, it has long been well known that wet concrete must be appropriately finished A wide variety of manually pushed troweling machines have previously been proposed. However, self propelled riding trowels finish the concrete quicker and more efficiently. Riding trowels enable a user to be seated upon the trowel frame, and the revolving rotors beneath the frame directly contact the surface of the concrete.

Machines of this general nature include some form of frame from which two or more rotating blades downwardly project. The blades are propelled by a self contained motor mounted on the frame, which may be linked to rotor gear boxes. The blades are controlled by gear mechanisms having a rotatable axis generally perpendicular to the frame, and a yoke controlled bearing assembly is often employed to vary rotor pitch. The weight of the trowel and the operator is transmitted frictionally to the concrete by the revolving blades. Steering is accomplished by tilting the blade rotor assemblies to generate differential vector forces that propel the frame.

Two of the most relevant prior art riding trowels known to us are seen in U.S. Pat. Nos. 3,936,212, Issued Feb. 3, 1976 and 4,046,484, issued Sep. 6, 1977. Both of the latter machines employ a frame having a seat for the operator that mounts two or more bladed rotors that project vertically downwardly underneath the frame carriage. Blades twistably associated with each rotor directly contact the concrete surface. Tilting forces on the rotors effectuate steering of the machine in various directions. The blades are rotated relative to the rotors (i.e., twisted) to effectuate different finishing characteristics by changing blade pitch. Both of the latter patents disclose lever means projecting vertically upward from the frame that may be manipulated by the driver to effectuate blade control. In patent 3,936,212, three individual rotor assemblies are shown, and none of the blades interlap with one another. In U.S. Pat. No. 4,046,484, the trowels intermesh to work overlapping circles, providing a gapless characteristic to obtain maximum width of surface coverage. More importantly, Pat. No. 4,046,484 teaches that rotor tilting forces needed for steering control may be applied to one of the rotors in two planes, whereas only a single plane of tilting is required for the other rotor.

A basic version of a twin rotor riding machine for surface finishing of concrete is seen in U.S. Pat. No. 2,898,826, issued Aug. 11, 1959. U.S. Pat. No. 4,859,114, issued Aug. 22, 1989 discloses a system for providing steering in a twin rotor concrete trowel by varying the position of frame sections to effectuate relative tilting movements of various frame portions U.S. Pat. No. 4,784,519, issued Nov. 15, 1988, discloses a linkage system for varying the pitch of the blade systems in unison, and an interlink system for tilting each blade to effectuate directional control. Other related riding trowels are seen in U.S. Pat. Nos. 4,775,306; 2,869,442; and 4,710,055.

However, as will be recognized by those skilled in the art, steering many known riding trowels is often cumbersome and difficult. Steering responses lag the lever inputs necessary to transmit and generate steering control instructions. It is often difficult for the contractor or owner of the machine to train an operator to properly use riding trowels in a short period of time. Even where the operator is relatively familiar with riding trowels, current steering systems are very challenging, and the steering response of known machines invites errors, collisions and accidents. Moreover, because of the typical blade and rotor assembly linkage construction employed in the prior art, impacting vibrations experienced on one rotor deleteriously effect movements of the other. The latter "bump-steering" problem compounds conventional riding trowel control deficiencies. When operating finishing machines with conventional blade controlling linkages in tightly confined areas where various obstacles exist, operation of conventional machines is slow and clumsy.

Some prior art machines are difficult to set up. Usually blade pitch control is difficult to set, and it has been difficult in the past for operators to measure pitch. Another problem is that it is sometimes difficult for an operator to clearly see those areas of the concrete surface that may need finishing the most. No known machines provide a means for sensing irregular surface areas. It is particularly difficult to lift known trowels in the field. Trowels require maintenance on a routine basis, and numerous adjustments and modifications are often required at the job site. Routine maintenance requires that blades be replaced periodically as they wear out. Some applications require that float shoes be attached to the blades. Occasionally finishing disks must be installed instead of blades. Other maintenance tasks must also be completed. Any time a change or modification to the blades is required the device must be lifted. In the past it has been difficult to properly lift the trowel for access to the blades underneath the frame. It is also difficult to load and unload riding trowels, since the blades, which are responsible for propulsion of the trowel over the concrete surface to be treated, cannot negotiate loading ramps or truck or trailer beds without damage.

Hence it is important to provide a self propelled motorized riding trowel that is capable of succinct and delicate maneuvers and which is relatively easily controlled by the operator. It is also important to provide a riding trowel of the character described that can be maintenanced by an operator safely and quickly with a minimum of down time. We have also determined that the loading and unloading of trowels must be streamlined.

SUMMARY OF THE INVENTION

We have developed a trowel lifting system for riding trowels that aids in transporting, adjusting and maintenancing riding trowels. Riding trowels can be easily and quickly transported and deployed at the job site through use of the system.

The riding trowel comprises a rigid metallic frame operationally offset from the concrete surface to be finished. The trowel comprises a pair of downwardly projecting rotors, each of which controls revolvable blades frictionally contacting the concrete surface. The frame comprises an upper deck having a generally planar surface upon which a pair of foot pedals and an operator seat are mounted. The pedals are each associated with an elevated cabinet mounted upon the frame deck. The frame mounts a battery, a fuel tank, and a conventional internal combustion motor for powering the trowel.

A pair of vertically upwardly extending primary steering control levers are linked to the rotors beneath the frame for trowel steering. By concurrently tilting each rotor, differential forces are generated by the revolving blades against the concrete surface, and vector moments resolve into steering forces. Hand movements transmitted by the operator to the steering control levers substantially correspond to the resultant direction of trowel travel.

Each rotor assembly comprises a rotatable blade assembly depending downwardly beneath the frame into contact with the concrete surface. Besides rotating about the rotor, the trowel blades are twisted through a limited rotation about their longitudinal axis to vary pitch. The pitch of each rotor blade is controlled by clutch and spider assemblies linked to convenient handle ends that can be manually rotated by the operator to vary the pitch.

Preferably each of the tiltable rotor assemblies are shaft driven by suitable gear boxes. The shafts from the gear boxes define a biaxial plane perpendicular to the machine frame deck, and steering of the apparatus is effectuated by pivoting the shafts (and the gear boxes) relative to the biaxial plane. Each gear box is movably mounted to the underside of the frame by a similar pivot steering box. The gear boxes are interconnected to the various steering linkages, and when they are deflected, the revolving blades are tilted to effectuate steering.

The trowel can be transported to and from the job site, and adjusted for maintenance in the field, by a user-removable wheel system. The wheel system comprises a cooperating pair of spaced apart, dolly wheel assemblies which are removably fitted to the front and back of the frame, so that the trowel may be pushed around for loading and unloading purposes in directions generally coincident with its longitudinal axis.

Each dolly wheel assembly comprises a rigid frame consisting of an upright, extensible stanchion supported upon a rigid cross piece. The cross piece extends between a pair of spaced apart wheels, and forms a carriage. The frame stanchion supports a rigid, upper coupling block that mounts a pair of rigid, spaced rods. These rods extend outwardly from the dolly wheel sections, and are adapted to be mated within suitable mandrels formed in the frame front and rear, about the trowel center of gravity.

The dolly stanchion comprises an upper, elongated tubular member which telescopingly and slidably receives a lower frame member. These cooperating elements are coaxially fitted together and they may be axially displaced or retracted by an internal screw jack. Suitable handles emanating from the top of each dolly wheel assembly may be twisted manually to raise or lower the trowel in response to extension or retraction of the dolly wheel system stanchions.

When the rotatable blades beneath the trowel are moved upwardly out of contact with the concrete surface, the trowel may be conveniently pushed about for loading or unloading. By moving the apparatus in a direction generally aligned with the trowel longitudinal axis, it will clear narrow areas, and it can be easily pushed up or down loading ramps.

Thus a fundamental object of the present invention is to provide a riding trowel for finishing concrete that is easy to load and unload. Another object is to provide a trowel that is convenient to service.

Another object is to enable a riding trowel to be easily moved about the job site without starting the motor.

A similar object is minimize wear and tear to the blades.

Another object is to provide a system that eases the routine maintenance tasks associated with riding trowels.

Another object of the present invention is to provide a riding trowel that is extremely mobile, and which can be moved easily and conveniently with a minimum of lifting.

A similar object of the present invention is to provide a riding trowel of the character described in which the center of gravity has been aligned with the carrying wheels to provide a carefully balanced and easily maneuvered system.

Another fundamental object of the present invention is to provide a transportation system for riding trowels of the character described which minimizes effort in maintenance and blade changes.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
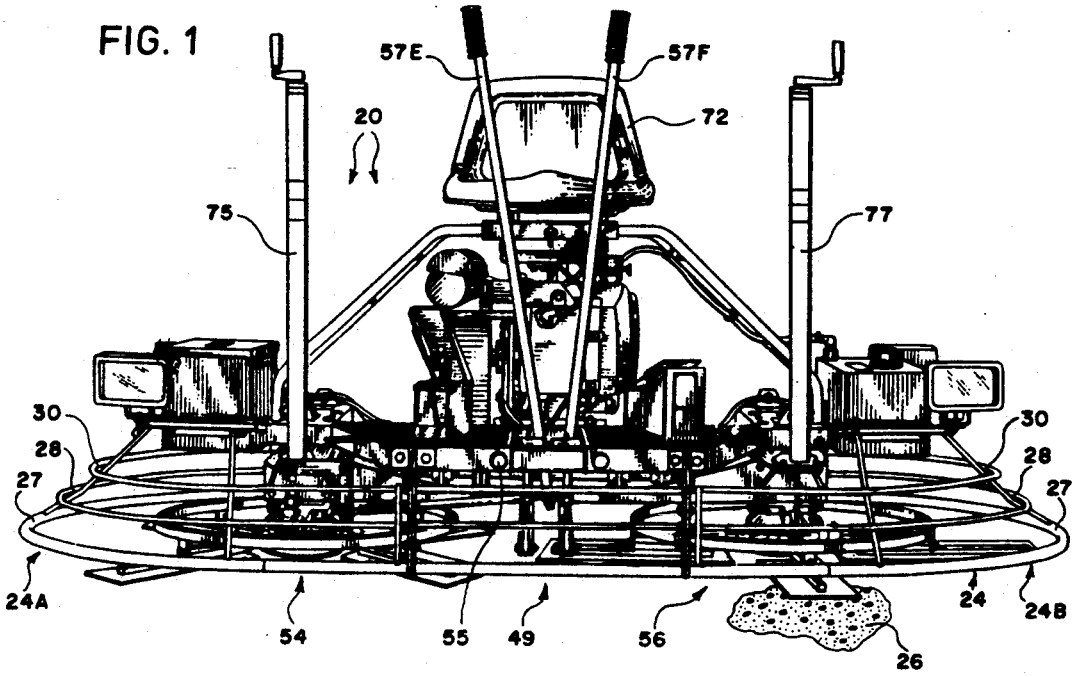
FIG. 1 is a front perspective view of our Riding Trowel for Concrete Finishing, with the wheel system removed.
Figure 2:
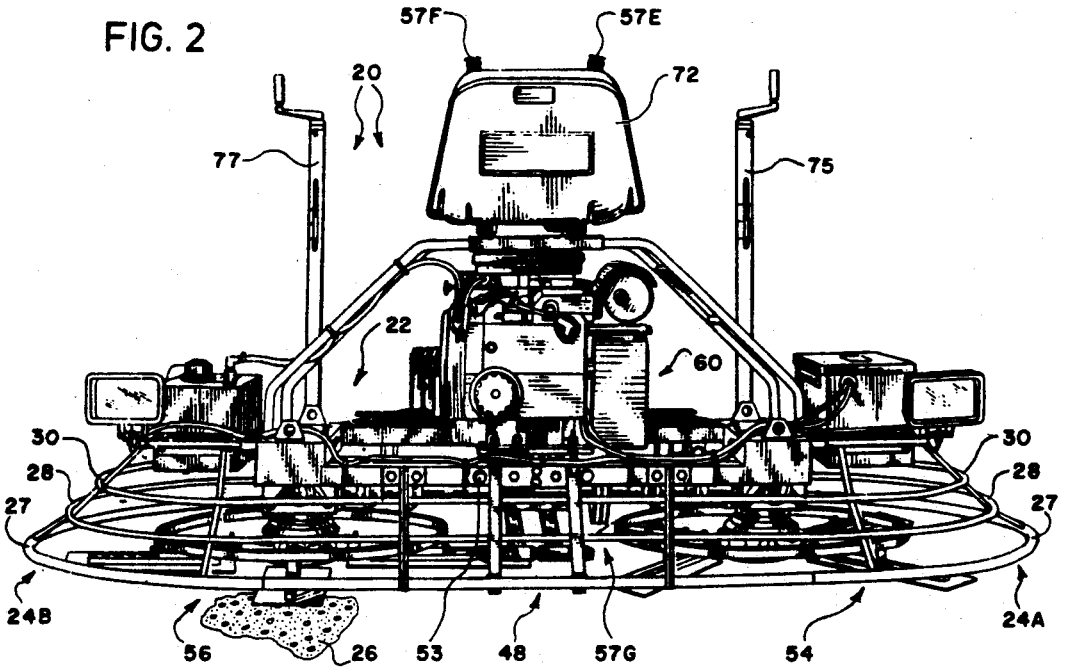
FIG. 2 is a rear perspective view thereof.

With initial reference now directed to FIGS. 1–4 of the appended drawings, a riding trowel for concrete finishing constructed in accordance with the present invention has been generally designated by the reference numeral 20. The highly maneuverable, self propelled riding trowel 20 may be precisely steered through the responsive steering and linkage system explained in detail in our previously filed patent application, Ser. No. 07/553,445, filed 07/13/90, and entitled Light Weight, Fast Steering Riding Trowel, which is hereby incorporated by reference, and which was referred to Group Art Unit 356, Examiner Nancy P. Connolly for Examination.

Figure 8:
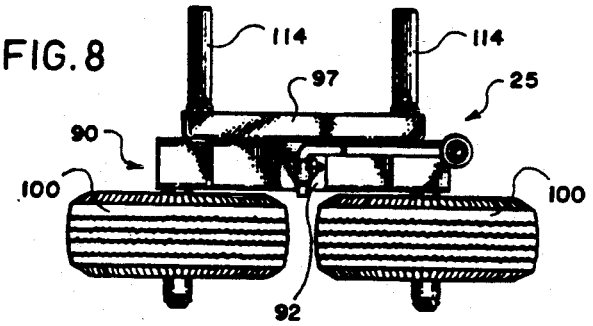
FIG. 8 is top plan view of the wheel system taken generally from a position above FIG. 6.
Figure 7:
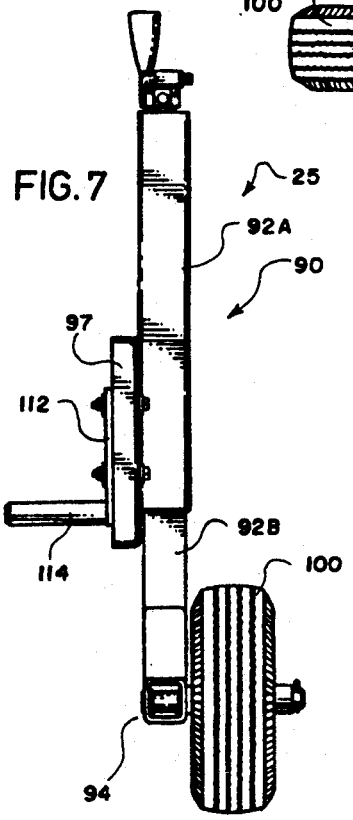
FIG. 7 is a left side elevational view of the wheel system taken generally from the left of FIG. 6.
Figure 6:
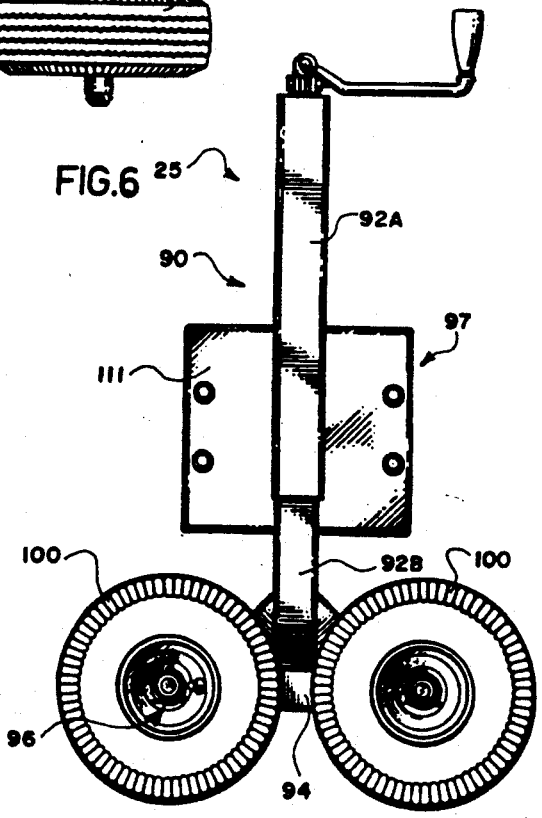
FIG. 6 is an enlarged, front elevational view showing the preferred wheel system.
Figure 9:
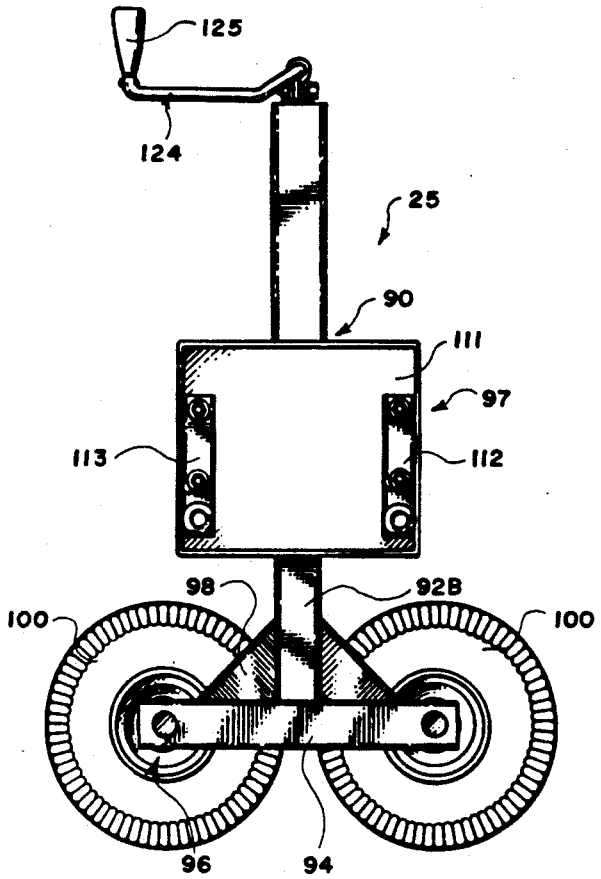
FIG. 9 is an enlarged, rear elevational view showing the preferred wheel system.
Figure 10:
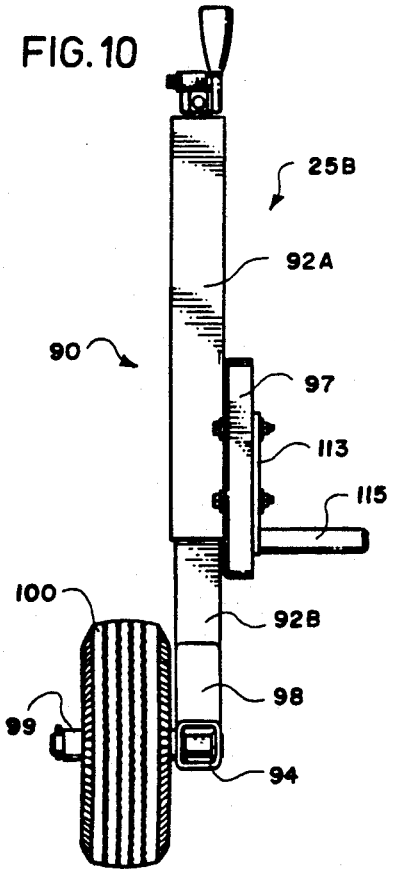
FIG. 10 is a right side elevational view of the wheel system taken generally from the right of FIG. 6.
Figure 10A:
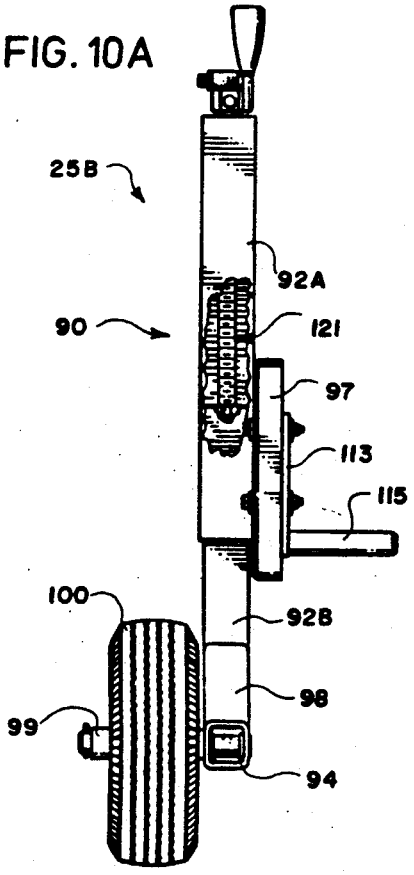
FIG. 10A is a fragmentary, right side elevational view of the wheel system similar to FIG. 10, but with portions thereof broken away or shown in section for clarity.

Our new riding trowel 20 comprises a rigid, metallic multipiece frame generally indicated by the reference numeral 22. The entire unit can be transported to and from the job site, and adjusted for maintenance in the field, by a user-removable wheel system comprising a pair of spaced apart, cooperating dolly wheel assemblies (FIGS. 8–10) to be described in detail hereinafter.

Figure 3:
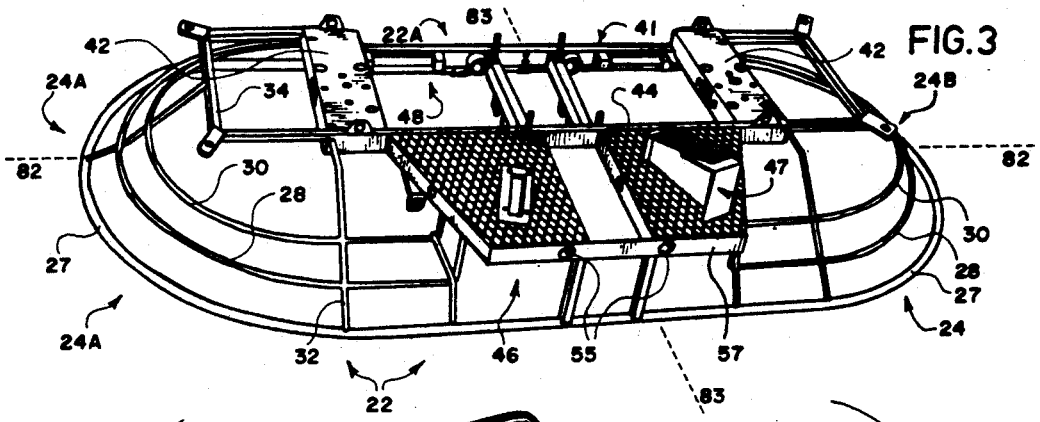
FIG. 3 is a top perspective view of the preferred frame.
Figure 5:
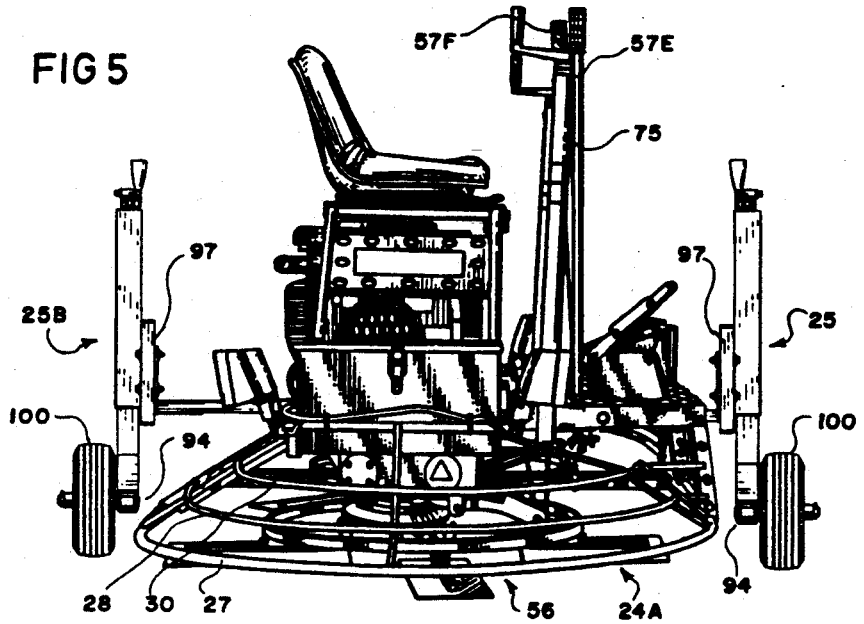
FIG. 5 is a side elevational view taken from a position generally to the left of FIG. 1, but with the auxiliary wheel system installed.

The dolly wheel system comprises a pair of similar jacking dolly wheel assemblies 25. As viewed in FIG. 5, the wheel assemblies 20, 25B are mounted to the frame upon the front and rear thereof. As appreciated from FIG. 5, the minimum dimensions of the riding trowel 20 appear in an end view. Stated another way, the distance between the front and back of the trowel is less than the distance between the opposite ends. Hence for maneuvering purposes we have found it desirable to move the trowel axially with respect to its longitudinal axis 82 (FIG. 3).

As explained previously, the trowel 20 is disposed above the concrete surface 26 to be finished by a pair of rotor assemblies, generally designated by the reference numerals 54 and 56. Each rotor assembly 54 and 56 comprises a rotatable blade assembly depending downwardly beneath the frame into contact with the concrete surface 26. Each rotor assembly includes a plurality of radially spaced apart blades that physically, frictionally contact the concrete surface 26 as the rotor rotates to finish the concrete. The blades are preferably rotated at 135 to 150 R.P.M. Each blade is linked to a central four blade spider by a connecting arm. Suitable spiders are rotatably coupled to a suspension gear box, that are driven by the motor to rotate the blades. Linkage, generally designated by the reference numeral 57G (FIG. 2), is manipulated to control the rotors 54 and 56 as described in our co-pending patent application.

The pitch of each rotor assembly 54, 56 is preferably individually controlled by a tubular handle assembly generally designated by the reference numerals 75 and 77 that includes suitable handles that can be rotated by the operator to vary the pitch of the trowel blades. Thus, in addition to rotating about the rotor, the trowel blades can be twisted through a limited rotation about their longitudinal axis to vary blade pitch. Spiders in contact with the blades are contacted by a clutch fork system generally to vary the pitch of the rotor blades between minimum and maximum positions. The handle assemblies activate the clutch forks. In the preferred embodiment the blade pitch may be varied between approximately zero to forty degrees relative to the plane of the surface being treated. The desired pitch used for finishing the concrete depends upon a number of variables 8 known to those skilled in the art such as the coldness, hardness, slump or wetness of the concrete. A flat pitch (i.e., zero degrees tilt) is ideal for working soft, wet surfaces. A maximum 1 pitch is desirable for burnishing harder, dryer surfaces. Intermediate pitches are used for plastic concrete of middle hardnesses.

Figure 4:
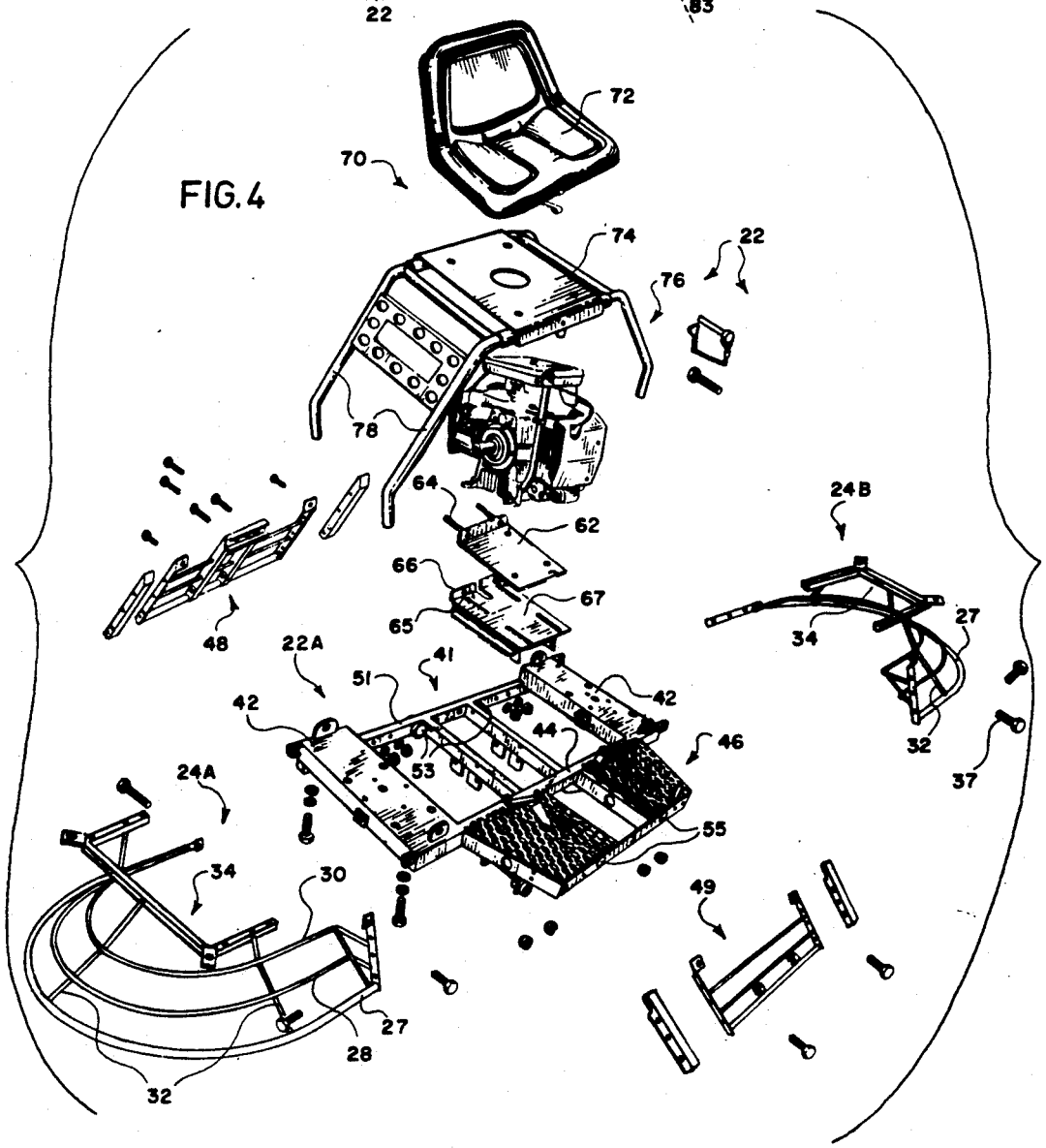
FIG. 4 is an exploded isometric assembly view of the preferred frame and seat assembly.

Frame 22 secures a lower, generally oval-shaped guard assembly 24 that is offset from the concrete surface 26 to be finished. Ring guard assembly 24 comprises a pair of separate, removable ring sections 24A and 24B that are bolted to opposite ends of the central frame section 22A. Each ring section comprises a lowermost, rigid ring 27 that is generally centered with respect to a pair of upper reinforcement ring segments 28 and 30 that are of reduced circumference. A plurality of radially spaced apart reinforcement spokes 32 extend between the lower ring 27 and the upper, terminal frame extension 34. Suitable fasteners 37 are employed to bolt the separate ring sections 24A, 24B to the end of the frame section 22A (FIG. 4).

The central frame section 22A comprises a generally cubical subframe 41, terminating in opposite end plates 42. The front edge 44 supports a forwardly projecting incline shelf 46 which mount control peddles 47 for control of the apparatus as explained in my prior patent. The rear side of the central subframe 41 mounts a rigid, generally rectangular and downwardly inclined guard 48 that, when assembled, extends between the two ring sections 24A and 24B at the rear of the frame 22. The rear rail 51 of the subframe 41 includes a pair of spaced apart mandrels 53 for receiving the dolly wheels to be described hereinafter. The incline shelf 46 includes a similar pair of cooperating spaced apart mandrels 55 defined in its edge 57 for supporting the opposite dolly wheel assembly as will hereinafter be described.

With reference to the aforementioned Holtz Pat. No. 4,046,484, the twin rotor assemblies in a riding trowel define a biaxial plane useful for referencing component movements. The rotors each comprise a vertical axis of rotation that together occupy and define a biaxial plane. A description of how basic steering is effectuated in riding trowels of this nature is afforded in the aforementioned patent, which is hereby incorporated by reference. Basically riding trowels of this nature steer by tilting the axis of rotation of the blade rotors in directions parallel (or substantially coincident) with the biaxial plane and/or perpendicular to it. By concurrently tilting each rotor, differential forces are frictionally generated by the revolving blades against the concrete surface, and vector moments resolve into steering and propulsion forces. In the latter reference, as is the case herein, blade orientation and rotation are synchronized properly to generate the propulsion forces.

As explained in our prior copending patent application rotor assembly 54 preferably tilts four ways—to the left and right and forwards and backwards. It's gear box movement thus defines planes perpendicular to the biaxial plane and parallel with the biaxial plane. However, rotor assembly 56 only tilts two ways, to the left or the right, defining a plane parallel with the biaxial plane. How a rotor may tilt is established by connection of its pivot steering As viewed by the seated operator rotor 56 revolves in a clockwise direction; rotor 54 revolves counterclockwise. Pivot steering boxes control each blade assembly. They enable the axis of rotation of the blades to be tilted appropriately to effectuate steering during operation.

The subframe 41 supports a motor, generally indicated by the reference numeral 60 that is mounted via plates 62, 63 to the subframe. Plate 62 comprises an engine adapter plate secured by suitable fasteners to the underside of the motor The adapter plate includes a pair of forwardly projecting studs 64 that are received within the suitable orifices 65, in edge 66 of the lower engine mounting plate 67. The motor is essentially centered over the center of gravity of the apparatus beneath the seat assembly that has been generally designated by the reference numeral 70 (FIG. 4).

Seat assembly 70 comprises a conventional seat 72 mounted to the upper receptive plate 74 secured to a seat mounting frame 76. The mounting frame 76 includes a pair of angled struts 78 depending downwardly from each side that are suitably fastened to the subframe 41. The operator disposed on seat 72 above the motor 60 is thus centered about the center of gravity above the subframe 41.

With primary reference now to FIGS. 5 through 10, typical dolly wheel assembly 25 comprises a rigid frame generally indicated by the reference numeral 90 that consists of an upright, rigid stanchion 92 projecting upwardly from a rigid cross piece 94. Stanchion 92 supports an upper coupling block 97, and its bottom is reinforced by webs 98. Cross piece 94 terminates in a pair of suitable bearings 96 that support axles 99 for rotatively mounting a pair of conventional drive wheels 100. It forms a carriage with the wheels to support the dolly wheel stanchion and the load borne thereby.

Figure 12:
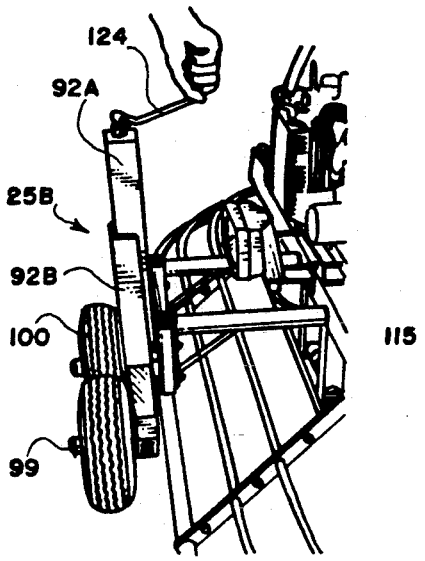
Figure 13:
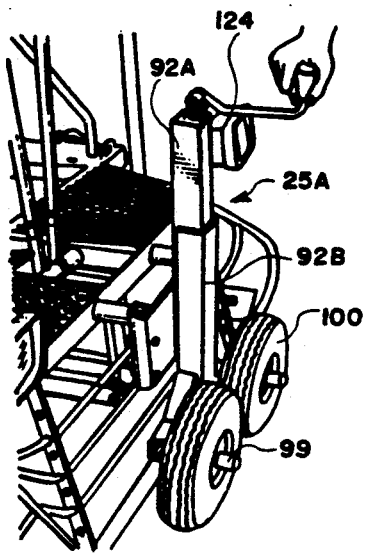

Each coupling block 97 comprises a rigid internal plate 111 that mounts a pair of spaced apart mounts 112, 113. Each of the mounts 112, 113, rigidly secure a rigid, elongated outwardly projecting rod 114. The only difference between dolly wheels 25 and 25B is that the rod 114 in dolly wheels system 25 is shorter than the rod 115 (FIG. 10) used in dolly wheel 25B. As seen in FIG. 12, rods 115 have a larger dimension to traverse. The rods 114 project outwardly into engagement with the mandrels 55 (FIG. 3) or 53 (FIG. 4) for removable coupling to the frame and subframe. Before the wheels can be adequately coupled by inserting the spaced apart rods 114 into the orifices as described, the height of the system must be appropriately adjusted.

Figure 11:
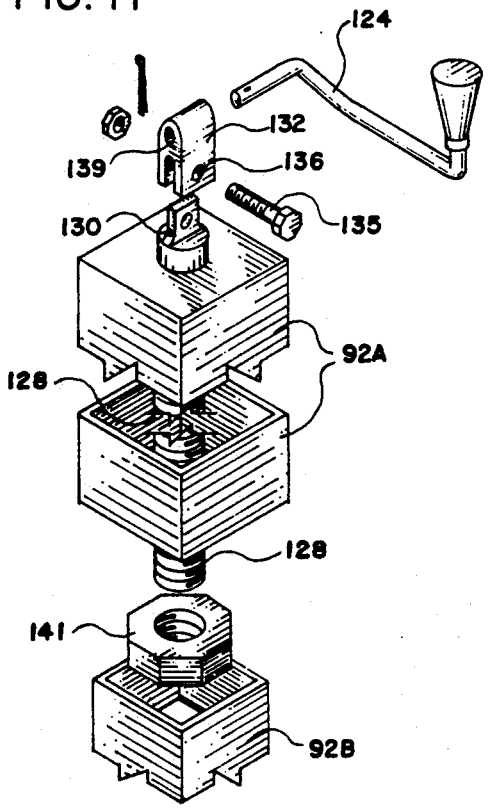
FIG. 11 is an enlarged, exploded isometric view of the preferred wheel jacking system; and, FIG. 12 and 13 are fragmentary pictorial views illustrating operation of the wheel system.

The frame stanchion comprises an upper elongated tubular steel member 92A which telescopingly and slidably receives a separate, lower tubular member 92B. These members are slidably coaxially, fitted together so that the stanchion may be telescopingly extended or retracted to lift or lower the trowel The stanchion elements are axially displaced by an internal adjustment system 121. System 121 terminates externally of upper member 92A in a rotatable handle 124 that can be rotated by grasping handle element 125 to rotate an internal threaded plunger 128 (FIG. 11). Plunger 128 extends upwardly outwardly of member 92A and terminates in a fitting 130 pivotally joined to a suitable coupling 132 via fastener 135 received through orifice 136. The ends of the handle 124 are rotatably fitted within the orifice 139 in fitting 132. The threaded plunger 128 extends downwardly through the apparatus concentrically and is threadably mated to a captivated nut 141 welded to the lower extensible member 92B. As rod 128 is rotated by manual rotation of handle 124, the effective height of the apparatus is varied. In other words plate 111 that is carried by the upper element 92A is moved upwardly or downwardly. This causes the rods 114 that are engaged in suitable orifices (i.e., mandrels) in the frame previously described to lift or elevate the frame to expose the underside.

When the rotatable blades beneath the trowel are moved upwardly out of contact with the concrete surface, the trowel may be moved conveniently for loading or unloading. By moving the apparatus in the direction generally aligned with it longitudinal axis 82 (FIG. 3) it may be easily moved about the job site. Also because of the reduced width of this dimension, it may be easily loaded on a conventional pickup truck through suitable ramps. When necessary to remove or adjust the blades underneath, or to add auxiliary materials such as disks or the like, suitably elevating the apparatus exposes the blades for work.

A transverse trowel axis 83 is generally perpendicular to the longitudinal axis 82 (FIG. 3) which it intersects at the center of gravity. Because there are a pair of wheels 100 spaced apart about the transverse axis 83, the wheels are substantially centered and the trowel is balanced and stable when lifted. The center of gravity of the motor and the seat etc., are substantially centered about transverse axis 83, and balance is achieved. In other words, when the dolly wheels are adjusted to a substantially identical height, the entire apparatus is stable, and it will not tilt. Both ends of the frame are moved out of contact with the ground, and the unit may be conveniently moved above a working surface without contacting the ground or damaging the blades.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A riding trowel for finishing a concrete surface, said riding trowel comprising:

seat means for supporting an operator of said riding trowel;

lever means accessible by said operator from said seat means for steering said riding trowel;

rigid frame means adapted to be disposed over said concrete surface for supporting said seat means and said lever means, said frame means comprising a front, a pair of spaced apart sides, and a pair of spaced apart ends;

motor means for powering said riding trowel;

rotor means comprising a pair of rotors associated with said frame means for frictionally contacting said concrete surface and supporting said frame means thereabove;

means for actuating said rotor means in response to said motor means thereby revolving said rotor means; and, dolly wheel means adapted to be coupled to said frame means for elevating said frame means out of contact with said surface, said dolly wheel means comprising a dolly wheel assembly removably coupled to said frame front and a cooperating dolly wheel assembly removably coupled to said frame rear.

2. The trowel as defined in claim 1 wherein said frame means comprises orifice means defined in said frame means front and rear, and said dolly wheel means comprises rod means for selectively engaging said orifice means.

3. The trowel as defined in claim 2 wherein each dolly wheel assembly comprises:

an upright vertical stanchion comprising a coaxially fitted together pair of telescoped members;

a wheeled carriage supporting said stanchion;

actuator means disposed within said frame for selectively extending or retracting the telescoped frame members; and, rotatable handle means for manually adjusting said actuator means.

4. The trowel as defined in claim 3 wherein said stanchion comprises an upper extensible member coaxially housing said actuator means, a lower extensible member rigidly coupled to said wheeled carriage, and wherein said rods means project outwardly from a mounting plate secured to said upper extensible member.

5. A motorized riding trowel for finishing a concrete surface, said riding trowel comprising:

rigid frame means adapted to be disposed over said concrete surface for supporting said seat means and said lever means, said frame means comprising a front, a pair of spaced apart sides, a pair of spaced apart ends, a longitudinal axis, and a transverse axis intersecting said longitudinal axis at the center of gravity; and, dolly wheel means coupled to said frame means for selectively elevating said frame means out of contact with said surface, said dolly wheel means comprising a dolly wheel assembly removably coupled to said frame front and a cooperating dolly wheel assembly removably coupled to said frame rear, each dolly wheel assembly comprising a pair of wheels adapted to be positioned about said transverse axis to balance said trowel, and selectively actuable jacking means for lifting the frame means out of contact with said surface

6. The trowel as defined in claim 5 wherein said frame means comprises orifice means defined in said frame front and said frame rear, and said dolly wheel means comprises a pair of spaced apart rods projecting generally horizontally outwardly toward said frame means for selectively engaging said orifice means on either side of said transverse axis.

7. The trowel as defined in claim 6 wherein each dolly wheel assembly comprises:

an upright vertical stanchion comprising a coaxially fitted together pair of telescoped members;

a wheeled carriage supporting said stanchion;

jacking means disposed within said frame for selectively extending or retracting the telescoped frame members; and, rotatable handle means for manually adjusting said jacking means.

8. The trowel as defined in claim 7 wherein said stanchion comprises an upper extensible member coaxially housing said actuator means, a lower extensible member rigidly coupled to said wheeled carriage, and wherein said rods means project outwardly from a mounting plate secured to said upper extensible member.

* * * * *